US007627921B2

(12) United States Patent
Azizinamini

(10) Patent No.: US 7,627,921 B2
(45) Date of Patent: Dec. 8, 2009

(54) GIRDER SYSTEM EMPLOYING BENT STEEL PLATING

(75) Inventor: Atorod Azizinamini, Lincoln, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 208 days.

(21) Appl. No.: 11/405,107

(22) Filed: Apr. 17, 2006

(65) Prior Publication Data

US 2006/0265819 A1 Nov. 30, 2006

Related U.S. Application Data

(60) Provisional application No. 60/671,736, filed on Apr. 15, 2005.

(51) Int. Cl.
*E01D 2/04* (2006.01)

(52) U.S. Cl. ..... 14/74.5; 29/897.35

(58) Field of Classification Search ..... 14/74.5, 14/78; 29/897.35
See application file for complete search history.

(56) References Cited

U.S. PATENT DOCUMENTS

| | | | | | |
|---|---|---|---|---|---|
| 1,913,342 | A * | 6/1933 | Schaffert | 52/588.1 |
| 3,100,556 | A * | 8/1963 | De Ridder | 52/588.1 |
| 3,182,343 | A * | 5/1965 | Larson | 14/69.5 |
| 3,397,497 | A * | 8/1968 | Shea et al. | 52/334 |
| 3,517,791 | A * | 6/1970 | Miles | 193/41 |
| 3,606,418 | A * | 9/1971 | Buker et al. | 403/363 |
| 3,812,636 | A * | 5/1974 | Albrecht et al. | 52/334 |
| 4,129,917 | A * | 12/1978 | Sivachenko et al. | 14/73 |
| 4,615,063 | A * | 10/1986 | Rolen | 14/18 |
| 4,706,319 | A * | 11/1987 | Sivachenko et al. | 14/73 |
| 4,926,776 | A * | 5/1990 | Corbett | 114/263 |
| 4,993,095 | A * | 2/1991 | Lautensleger et al. | 14/74.5 |
| 5,339,475 | A * | 8/1994 | Jaeger et al. | 14/73 |
| 6,205,740 | B1 * | 3/2001 | Ekerholm et al. | 52/846 |
| 6,434,903 | B1 * | 8/2002 | Hertweck | 52/334 |
| 6,669,551 | B2 * | 12/2003 | Kennedy et al. | 454/169 |
| 6,708,362 | B1 * | 3/2004 | Allen | 14/73 |
| 7,069,614 | B1 * | 7/2006 | Sivachenko et al. | 14/73 |
| 7,155,874 | B2 * | 1/2007 | Lee | 52/731.2 |
| 7,156,243 | B2 * | 1/2007 | Henning et al. | 211/153 |
| 7,207,079 | B2 * | 4/2007 | Kennedy | 14/73 |

* cited by examiner

*Primary Examiner*—Raymond W Addie
(74) *Attorney, Agent, or Firm*—David H. Milligan; Sean P. Connolly; Husch Blackwell Sanders LLP

(57) ABSTRACT

A structural support system employs a modified inverted box girder design for improved performance and ease of fabrication. Each girder of a series of girders is formed with an upper flange section, a set of web sections extending from opposite lateral sides of the upper flange section, and a base section below the web sections. The base section includes individual flanged footings that project generally towards one another. The particular cross-sectional configuration of each girder may be formed by bending a continuous steel plate along at least a first set of preselected parallel lines to establish a set of upper continuous transitional bends with the upper flange section therebetween, as well as a remainder portion forming at least the set of web sections. A deck is coupled with the series of girders to form the structural support system.

15 Claims, 3 Drawing Sheets

GIRDER SYSTEM EMPLOYING BENT STEEL PLATING

CROSS-REFERENCE TO RELATED APPLICATIONS

This application claims priority to commonly owned U.S. provisional application Ser. No. 60/671,736, filed Apr. 15, 2005, incorporated by reference in its entirety.

STATEMENT REGARDING FEDERALLY SPONSORED RESEARCH OR DEVELOPMENT

Not applicable.

BACKGROUND OF THE INVENTION

Structural support systems, such as those used in buildings or bridges, often incorporate steel girders to form a load-carrying element. For instance, in the case of bridges, the generally horizontally extending girders provide support to an overlying superstructure (e.g., a bridge deck) and transfer loads to support columns or other structures anchored to the ground. Girders have a variety of cross-sectional configurations, such as I-beam and box-shaped, each providing specific advantages depending on the particular design parameters for a load carrying system. In certain situations, for example, it is desirable to maximize the strength-to-weight ratio for a girder design, while other situations dictate the incorporation of girders that are, above other considerations, easy to fabricate with low maintenance over time.

Despite advances in design for load carrying systems, conventional fabrication methods for steel girders are still generally labor intensive, and result in a finished product that is relatively expensive. With both I-beam and box girder configurations, for example, there is a large amount of welding that must be done to secure the main structural components of the girder together. Furthermore, because of the extent of welding that is necessary, there is frequently a long delay introduced from the time a particular girder design is chosen to the time a load carrying system is constructed on-site. Bridges employing girders having certain cross-sectional configurations also require cross frames to be coupled between adjacent girders in order to maintain sufficient structural stiffness of the load carrying system. These cross frames add to the expense, maintenance cost and labor of bridge installation.

Overall, there is increased desire for load carrying systems that can be more rapidly deployed at a relatively low cost. In certain applications, for example, pre-assembly of significant components of a load carrying system, such as a bridge deck and supporting girders, would provide for faster installation of a bridge system. It would also be advantageous to have a fabrication method for steel girders in which an individual girder pattern could be easily duplicated such that a series of matching girders may be formed.

SUMMARY OF THE INVENTION

A structural support system is provided utilizing bent steel plate girders. The girders employ a modified inverted box cross-sectional configuration to provide a longitudinal load-carrying member with good structural stability and relative simplicity in fabrication. In one aspect, the girder is formed with an upper flange section, a set of web sections extending from opposite lateral sides of the upper flange section, and a base section below the web sections. The upper flange section may be formed with a longitudinal ridge to increase the buckling capacity of the girder, as well as provide a feature for physically coupling the girder with an overlying superstructure, such as a bridge deck, to form the structural support system. A set of upper transitional bends form the interface between the upper flange section and the web sections. The base section includes individual flanged footings that project generally towards one another.

In another aspect, the aforementioned girder configuration may be embodied in various cross-sectional forms. For instance, the set of web sections may be parallel with one another, or may be arranged in a divergent relationship moving away from the upper flange section. As another variation optimally for longer span girders, the flanged footings, in addition to projecting towards on another, also project in opposed directions from a lower edge of each of the web sections, such that each web section is straddle by one of the flanged footings.

The cross-sectional configuration of girder, in another aspect, is formed by bending a continuous steel plate along at least a first set of preselected parallel lines to establish the set of upper continuous transitional bends and the upper flange section therebetween, as well as a remainder portion forming at least the set of web sections. Optionally, the remainder portion of the steel plate may be bent along a second set of preselected parallel lines to establish a set of lower continuous transitional bends that defines individual flanged footings of the base section extending from the web sections. Alternatively, flanged footings may be welded or otherwise secured onto a lower edge of each of the web sections. As a further option, an upward bend generally parallel with the first set of preselected parallel lines may be formed along a centerline of the upper flange section to establish a longitudinal ridge for physically coupling the girder with an overlying superstructure. This arrangement also allows a concrete slab deck encasing a grid of reinforcing members to optionally be formed simultaneous with the coupling of a series of girders to the superstructure deck by extending the reinforcing members through the longitudinal ridge of each girder upper flange section.

As described, the structural support system possessing a modified inverted box cross-sectional configuration, and method of assembly therefore, provide a rapidly deployable load-carrying system with a reduced number of fabrication steps as compared to conventional methods. Particularly in the case of the girder formed entirely by bending processes, an individual girder pattern may be selected and quickly duplicated to generate a series of matching girders for a given bridge span or other structural support system design. Structural support systems of the present invention may be formed by joining a series of girders with an overlying deck at an installation site, or may be deployed to an installation site as a preassembled deck/girder unit.

Additional advantages and features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 1:
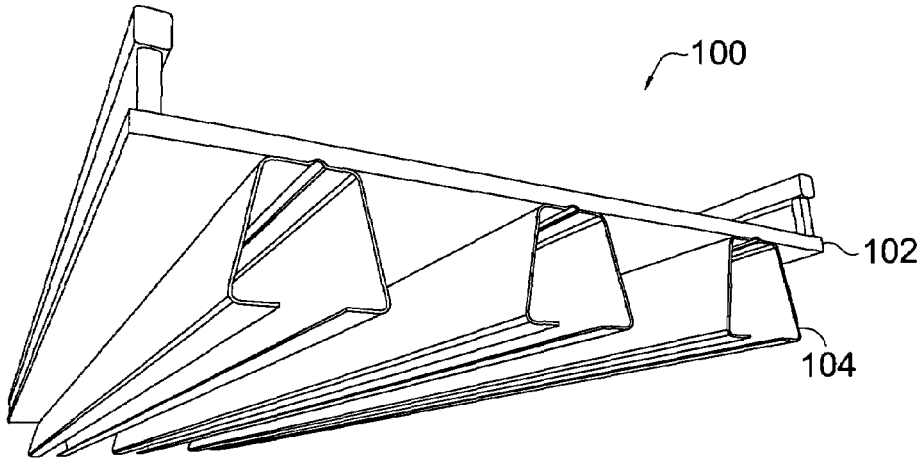
FIG. 1 is a perspective view of a structural support system incorporating a series of longitudinally oriented girders coupled to a superstructure.

Turning now to the drawings, and initially to FIG. 1, a structural support system 100 is depicted for providing a load-carrying element. The system 100 is particularly well suited for supporting loads upon a deck 102 supported by a series of underlying girders 104 that extend generally in a horizontal longitudinal orientation, such as in the form of a bridge span or building floor span. It should be understood, however, that the orientation of the deck 102 and underlying girders 104 may vary from the horizontal, such as in the case of a bridge span having a convex or concave longitudinal profile with respect to the horizontal plane, or ascending or descending in elevation longitudinally over the span. Additionally, descriptions of deck 102 or girder 104 components or features as being "upper" or "lower", and orientations or interrelations of such components or features described as "upwardly", "downwardly", "underlying" or "overlying", are with reference to the deck 102 and girder 104 extending in a horizontal longitudinal arrangement. Those of skill in the art will appreciate how such terminology is adjusted when the system 100 and components thereof are utilized in other spatial arrangements, such as in a vertically upturned arrangement, as will be discussed hererin.

Figure 2A:
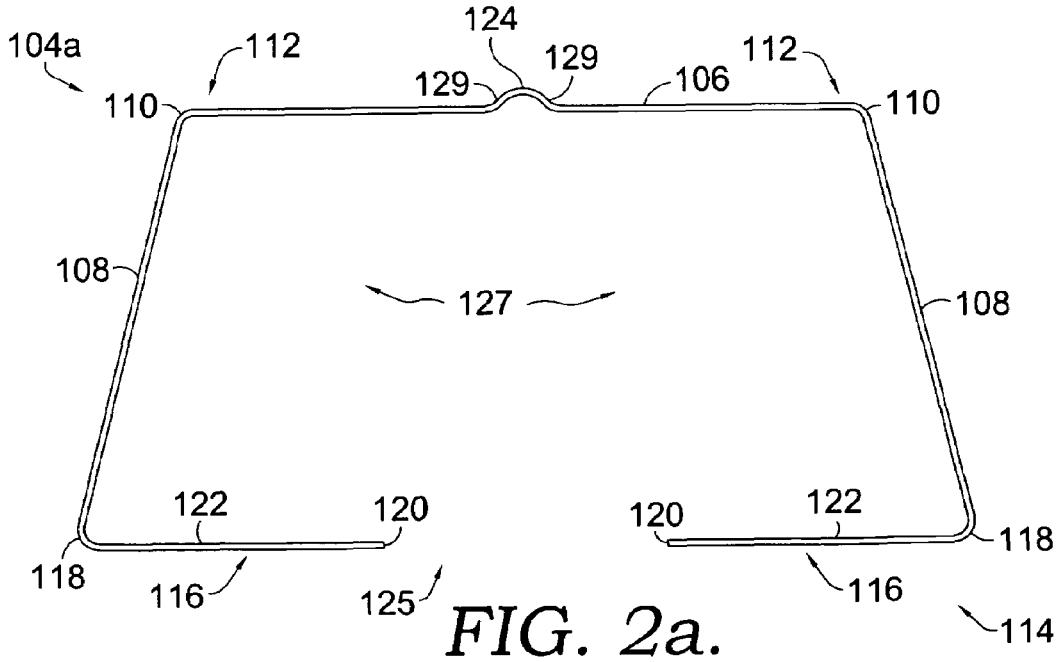
FIGS. 2*a*, 2*b* and 2*c* show cross-sectional profiles taken transversely though various embodiments of the longitudinally oriented girders.
Figure 2B:
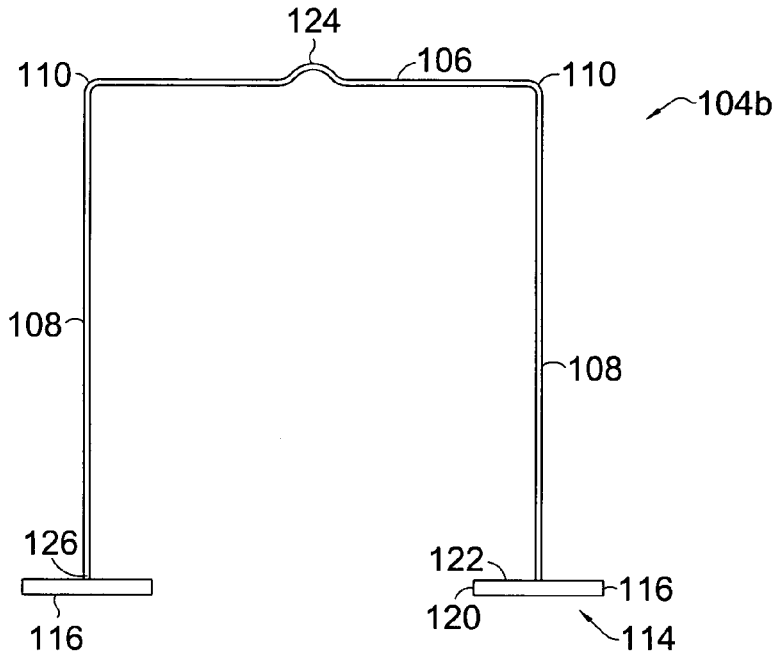
Figure 2C:
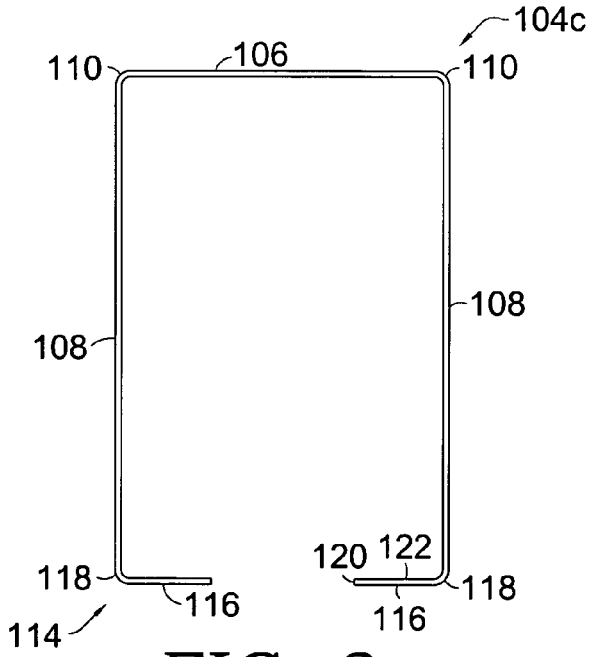

With continued reference to FIG. 1, and additional reference to FIGS. 2*a*-2*c*, various embodiments of the girder 104 (also labeled as girder 104*a*, 104*b*, or 104*c* in correspondence with FIGS. 2*a*-2*c*) are illustrated in a cross-sectional profile. Each embodiment of the girder 104 includes an upper flange section 106, a set of web sections 108 extending downwardly from a set of upper continuous transitional bends 110 formed on opposite lateral sides 112 of the upper flange section 106, and a base section 114 including individual flanged footings 116 formed below the set of web sections 108. The girders 104 illustrated in FIGS. 2*a*-2*c* may be fabricated either partially or wholly by a bending process of a continuous steel plate, as will be explained in further detail herein.

The embodiment of the girder 104*a* illustrated in FIG. 2*a*, and shown for exemplary purposes coupled to the bridge deck 102 of FIG. 1, also includes a set of lower continuous transitional bends 118 separating each web section 108 from one of the flanged footings 116. The flanged footings 116 project generally laterally towards one another, each extending to a terminal edge 120. The flanged footings 116 may also have a flat profile or a slightly downwardly sloped profile moving towards the terminal edge 120 to allow any moisture that collects onto a top surface 122 of the footings 116 to drain off of the terminal edge 120 when the girder 104 and deck 102 are installed in the horizontal longitudinal arrangement. In the particular embodiment of FIG. 2*a*, the web sections 108 of the girder 104*a* are aligned in a divergent relationship with one another moving away from the upper flange section 106. However, the web sections 108 may also be parallel with one another, as in the embodiments of the girder 102*b* and 102*c* illustrated in FIGS. 2*b* and 2*c*, respectively. Those of skill in the art will appreciate that the relative web section 108 orientations are a matter of design choice based on the desired load-carrying capacity of the girder, and other engineering design factors. The girder 104*a* also has a longitudinally extending ridge 124 positioned along a longitudinal centerline of the upper flange section 106. The ridge 124 is raised upwardly above the plane of the upper flange section 106, and serves to provide increased buckling capacity from the girder 104*a* while also providing a feature for physically coupling the deck 102 with the girder 104*a*, as will be explained herein with reference to FIG. 3.

The embodiments of the girders 104*b* and 104*c* illustrated in FIGS. 2*b* and 2*c*, respectively, share some of the same features with the girder 104*a* of FIG. 2*a*. For instance, girder 104*b* of FIG. 2*b* has the longitudinally extending ridge 124 formed on the upper flange section 106, while the girder 104*c* of FIG. 2*c* includes the set of lower continuous transitional bends 118 between the web sections 108 and the flanged footings 116. The girder 104*c* also possesses flanged footings 116 projecting in the same orientation as with the girder 104*a* of FIG. 2*a*. On the other hand, the girder 104*b* of FIG. 2*b* differs from both of the girders 104*a* and 104*c* of FIGS. 2*a* and 2*c*, respectively, by having each flanged footing 116 arranged to straddle a lower edge 126 of one of the web sections 108. In each embodiment, it is preferred to have some lateral distance between the flanged footings 116 so as to create a continuous channel opening 125 therebetween. This not only provides the advantage of a longitudinal gap where moisture can drain off of the top surface 122 of the footings 116, but if sufficiently large, the opening 125 allows for persons to inspect the inner surface region 127 of the girder 104 for cracks, corrosion, or other degradation that can occur over time. With a traditional box girder, for example, such an inspection may be difficult, if not impossible, due to a lack of access to the girder inner surface region.

As referenced above, each girder profile 104 illustrated in FIGS. 2*a*-2*c* may be fabricated at least partially by a bending process of a continuous steel plate. In such a case, the longitudinal dimension of the girder is limited by the length of a steel plate attainable, and may further be limited by size of plate bending equipment that is utilized. In one exemplary arrangement, girder longitudinal spans of up to 105 feet are contemplated based on a steel plate thickness of one-half of an inch. However, other girder spans and steel plate thicknesses are contemplated by the present invention, and any specific dimensional values recited herein should not be construed as limiting the scope of the present invention. A steel plate thickness of three-eighths of an inch for a girder longitudinal span of up to 50 feet, for instance, is another potential configuration. Steel plates chosen to form the girder 104 include those made of high quality carbon steel, with one particular material choice being A1010 martensitic steel due to its resistance to corrosion.

In the bending process, a first set of parallel lines are selected to correspond to the locations where a steel plate is bent to form the upper continuous transitional bends 110, with the upper flange section 106 established between the bends 110 and presenting a flange section width selected according to the location of the bends 110. In the case of the girders 104*a* and 104*c* of FIGS. 2*a* and 2*c*, the process also involves the selection of a second set of parallel lines corresponding to the locations where the remaining portion of the steel plate is bent to form the lower continuous transitional bends 118. This step establishes the "height" or dimension of each web section 108 between the upper and lower continuous transitional bends 110, 118, as well as the dimension of each flange footing 116 between the lower continuous transitional bend 118 and the terminal edge 120 of each footing 116. Optionally, the longitudinally extending ridge 124 is formed by bending the upper flange section 106 along a third set of parallel lines 129. The aforementioned bending process involving the formation of upper and lower transitional bends 110, 118 may be accomplished by plate bending equipment under the control of an automated system. For instance, equipment incorporating computer numeric control (CNC) may be used to select a particular girder profile and then implement a bending process to form the particularly dimensioned girder 104 repeatedly, if desired.

An alternative fabrication process takes place for the girder 104*b* of FIG. 2*b*. After the upper continuous transitional bends 110 are formed, the remaining portion of the steel plate serves as the web sections 108, each terminating at the lower edge 126. A flange footing 116 is then welded onto the lower edge 126 of each web section 108 such that the lower edge 116 straddles the footing 116. The footing 116 may have an increased thickness over the remainder of the girder 104*b*, depending on strength and stability requirements.

Figure 3:
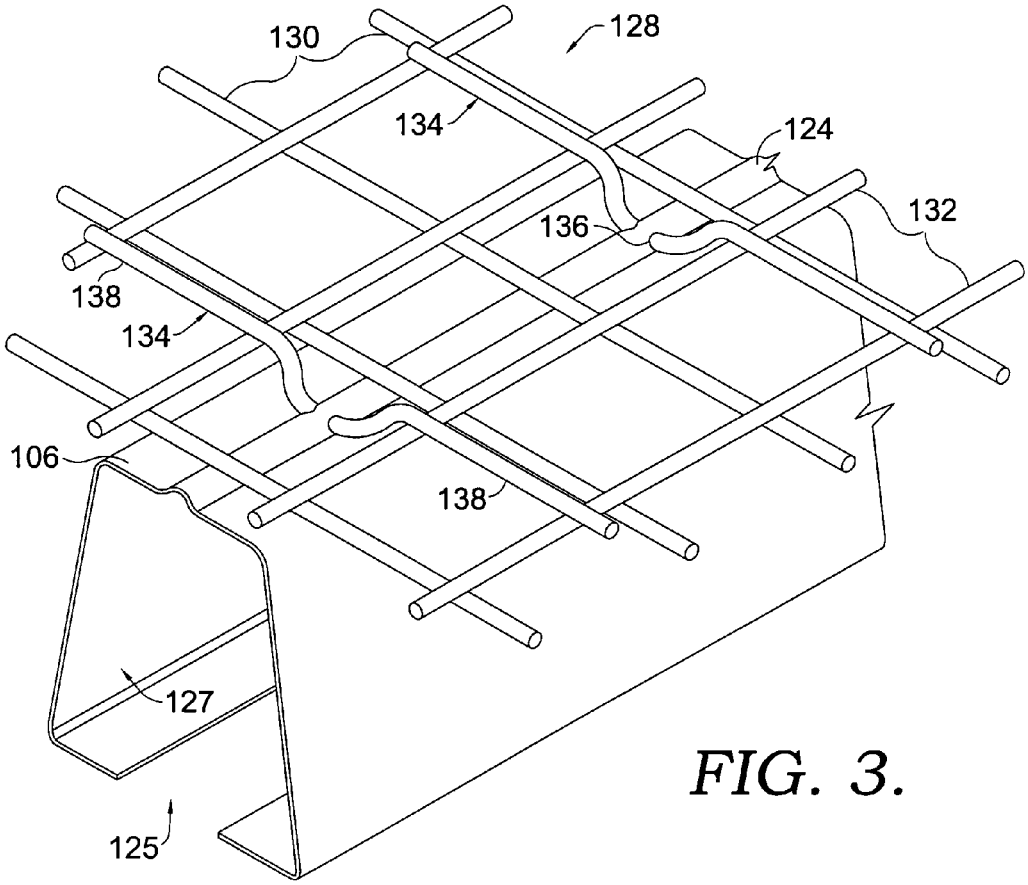
FIG. 3 is a fragmentary perspective view of a grid of reinforcing members of a superstructure coupled with a feature of an upper flange section of one of the girders.

One particular arrangement for coupling the girders 104*a* and 104*b* with the deck 102 involves the use of reinforcing members 128 encased with the concrete deck 102, shown in FIG. 3 without the deck 102 in place. The reinforcing members 128 may be steel reinforcing bars commonly used in road and bridge construction. The concrete deck 102 includes a grid of reinforcing members 128 extending generally in the horizontal plane in alternating layers characterized by transversely extending members 130 in one layer and longitudinal members 132 in either an overlying or underlying layer with respect to the transverse members 130. Particular coupling members 134 of the reinforcing members 128 are each shaped to extend through an aperture 136 formed generally transversely through the longitudinally extending ridge 124, with opposed sides 138 bending upwardly and over the longitudinal members 132. A plurality of apertures 136 are spaced along the ridge 124 in the longitudinal direction. Once the coupling members 134 are installed through each of the apertures 136 of the longitudinally extending ridge 124, concrete may be cast around the reinforcing members 128 to encase the member 128 and form the deck 102 overlying the upper flange section 106 and the longitudinally extending ridge 124. This configuration provides the advantage of establishing an interlocking composite action between the deck 102 and the girders 104 to more evenly distribute stresses throughout the system 100 while preventing lateral movement of the deck 102 relative to the girders 104.

As an alternative coupling arrangement between the deck 102 and the girder 104, if the longitudinally extending ridge 124 is not incorporated into the upper flange section 106, other means known to those of skill in the art may be employed to physically couple the girders 104 with the deck 102. For instance, a threaded bolt (not shown) may be screwed downwardly through the concrete deck 102 and fastened through an aperture (not shown) in the upper flange section 106 to secure the deck 102 to the girders 104 and prevent lateral movement of the deck 102 relative to the girders 104.

Figure 4:
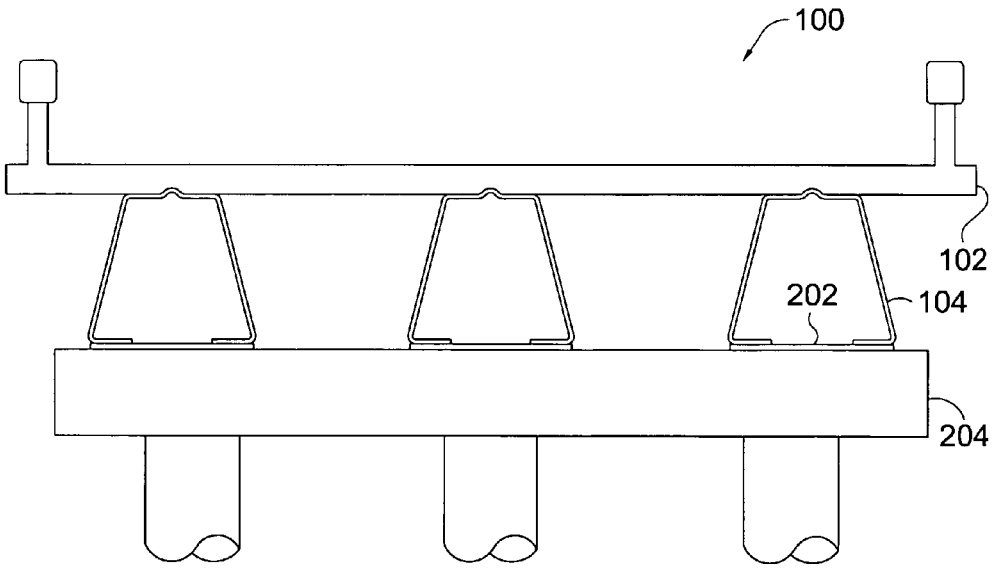
FIG. 4 is a front elevational view of the structural support system installed on a column support.

With reference to FIG. 4, the system 100 including bridge deck 102 and series of girders 104 is shown within an exemplary completed bridge installation 200. The girders 104 are mounted upon a series of bearing plates 202 that overlie a column support 204. Specifically, the flanged footings 116 of each girder 104 rest upon the bearing plates 202. It should be understood that the bridge installation 200 is merely illustrative of one exemplary arrangement incorporating the system 100 of the present invention.

As mentioned above, it is contemplated that the system 100 may be oriented such that the deck 102 extends in a vertical plane and the girders 104 extend in either a horizontal longitudinal alignment, one above the other, or in a vertical longitudinal alignment. In other words, the system 100 may be turned upwardly and secured to a stable structure to act as a retaining wall, in one example, for earthen material.

As can be understood, the structural support system 100 of the present invention incorporating the particular girder 104 design results in a load carrying structure that may be easily assembled and rapidly deployed in a bridge installation. Furthermore, the present invention provides a low maintenance girder 104 that can be easily inspected for structural integrity when the need arises.

Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A load-carrying girder presenting a longitudinal span for supporting an overlying superstructure, comprising:

an upper flange section defining a bearing surface, the upper flange section having a longitudinally extending ridge;

a set of upper continuous transitional bends formed on opposed lateral sides of the upper flange;

a set of web sections spaced apart from one another, each web section extending downwardly from one of the transitional bends; and a base section formed below and extending from the set of web sections, the base section including individual flanged footings projecting generally laterally towards one another;

wherein the ridge of the upper flange is formed with a set of laterally extending, spaced apart apertures formed therethrough, the apertures being configured to receive a reinforcing member.

2. The girder of claim 1, wherein the base section further includes:

a set of lower continuous transitional bends each formed at a bottom portion of one of the web sections of the set of web sections, the flanged footings extending from the set of lower continuous transitional bends.

3. The girder of claim 2, formed by a process including the steps of:

bending a continuous steel plate along a first set of preselected parallel lines to establish the set of upper continuous transitional bends and the upper flange section between the set of upper continuous transitional bends; and bending the continuous steel plate along a second set of preselected parallel lines to establish the set of lower continuous transitional bends, the set of web sections between the set of upper continuous transitional bends and the set of lower continuous transitional bends, and the flanged footings.

4. The girder of claim 1, wherein the set of web sections are arranged in a divergent relationship with one another moving away from the upper flange section.

5. The girder of claim 1, wherein the flanged footings of the base section are configured such that a continuous channel opening is formed therebetween.

6. A structural support system comprising:

one or more longitudinally oriented girders, each girder having an upper flange section defining a bearing surface, a set of web sections extending downwardly from transitional bends formed on opposed lateral sides of the upper flange section, and a base section formed below the set of web sections, the base section including individual flanged footings projecting generally laterally towards one another; and a deck coupled to the one or more girders through the upper flange section, the deck having a bottom surface overlying the bearing surface of the series of girders;

wherein the upper flange section of each girder is formed with a longitudinally extending ridge having a set of spaced apart apertures through which the deck couples with the series of girders.

7. The support system of claim 6, wherein the set of web sections of each girder are arranged in a divergent relationship with one another moving away from the upper flange section.

8. The support system of claim 6, wherein the flanged footings of the base section of each girder are configured such that a continuous channel opening is formed therebetween.

9. The support system of claim 6, formed by a process including the steps of:

a) fabricating each girder of the one or more girders, the step of fabrication including bending a continuous steel plate along a plurality of preselected longitudinal lines to form at least the upper flange section and the set of web sections of a respective girder;

b) fabricating the deck as a concrete slab encasing a grid of reinforcing members; and c) coupling the deck to the series of girders;

wherein steps (b) and (c) are performed either simultaneously or separately.

10. The support system of claim 9, wherein process step (a) further includes forming the base section through the fabrication step of bending the continuous steel plate along the plurality of preselected longitudinal lines.

11. The support system of claim 9, wherein process step (c) includes extending at least some of the reinforcing members through a raised feature of the upper flange section of each girder.

12. The support system of claim 11, wherein the raised feature of the upper flange section comprises a longitudinally extending ridge formed with a set of spaced apart apertures.

13. A method for fabricating a load-carrying element of a structural support system, comprising:

bending a series of continuous steel plates along a plurality of preselected longitudinal lines to form a series of load-carrying girders, each girder having an upper flange section defining a bearing surface, a set of web sections extending downwardly from transitional bends formed on opposed lateral sides of the upper flange section, and a base section formed below the set of web sections, the base section including individual flanged footings;

forming a concrete slab deck encasing a grid of reinforcing members; and coupling the deck to each girder of the series of girders such that the series of girders extend in a parallel arrangement with respect to one another; and wherein coupling the deck to each girder includes extending at least some of the reinforcing members through a raised feature of the upper flange section of each girder.

14. The method of claim 13, wherein the flanged footings of the base section project generally laterally towards one another.

15. The method of claim 13, wherein the raised feature of the upper flange section comprises a longitudinally extending ridge formed with a set of spaced apart apertures.

* * * * *